US009351521B2

(12) United States Patent
Drezen et al.

(10) Patent No.: US 9,351,521 B2
(45) Date of Patent: May 31, 2016

(54) METHOD OF WRAPPING SMOKING ARTICLE RODS

(75) Inventors: Yves Drezen, Nantes (FR); Fabian Rieth, Hamburg (DE)

(73) Assignee: Imperial Tobacco Ltd., Bristol (GB)

( * ) Notice: Subject to any disclaimer, the term of this patent is extended or adjusted under 35 U.S.C. 154(b) by 1180 days.

(21) Appl. No.: 13/383,176

(22) PCT Filed: Jun. 25, 2010

(86) PCT No.: PCT/EP2010/003902

§ 371 (c)(1),
(2), (4) Date: Mar. 22, 2012

(87) PCT Pub. No.: WO2011/003525

PCT Pub. Date: Jan. 13, 2011

(65) Prior Publication Data

US 2012/0266902 A1 Oct. 25, 2012

(30) Foreign Application Priority Data

Jul. 7, 2009 (EP) ..... 09305656

(51) Int. Cl.
*A24C 5/10* (2006.01)
*A24C 1/30* (2006.01)

(52) U.S. Cl.
CPC ..... *A24C 1/30* (2013.01)

(58) Field of Classification Search
CPC ..... A24C 1/28; A24C 1/30
See application file for complete search history.

(56) References Cited

U.S. PATENT DOCUMENTS 3,794,048 A * 2/1974 Molins et al. ..... A24C 1/30 131/29
4,324,233 A * 4/1982 Baier et al. ..... A24C 1/30 128/105.1

FOREIGN PATENT DOCUMENTS

CH 369996 A 6/1963
EP 0029295 A1 5/1981

(Continued)

OTHER PUBLICATIONS

FR 2 539 916—Mechanical English Tranlsation—printed from http://translationportal.epo.org/emtp/translate/?ACTION=description-retrieval&COUNTRY=FR&ENGINE=google&FORMAT=docdb&KIND=A1&LOCALE=en_EP&NUMBER=2539961&OPS=ops.epo.org/3.1&SRCLANG=fr&TRGLANG=en on Sep. 28, 2015.*

(Continued)

*Primary Examiner* — Michael H Wilson
*Assistant Examiner* — Dionne Walls Mayes
(74) *Attorney, Agent, or Firm* — Hovey Williams LLP

(57) ABSTRACT

The disclosure relates to a method of wrapping smoking article rods with a wrapper. A bobbin comprising a wound web (8) and individual spaced wrappers (2) is provided. The wrappers (2) each have a longitudinal axis ($L_w$) and are arranged side by side on the web (8). The bobbin is unwound, and an unwound section of the web (8) is guided across a support, preferably a support plate, wherein the wrappers (2) on that section of the web (8) are exposed. Individual smoking article rods (1), which have their longitudinal axes ($L_r$) generally arranged in parallel, are fed towards the support under an oblique angle ($\alpha$) between the longitudinal axes ($L_r$, $L_w$) of the smoking article rods (1) and of the wrappers (2). Each smoking article rod (1) is rolled over one of the wrappers (2), wherein that wrapper (2) is taken up by that smoking article rod (1) and helically wound about that smoking article rod (1).

30 Claims, 9 Drawing Sheets

(56) References Cited

FOREIGN PATENT DOCUMENTS

Figure 1:
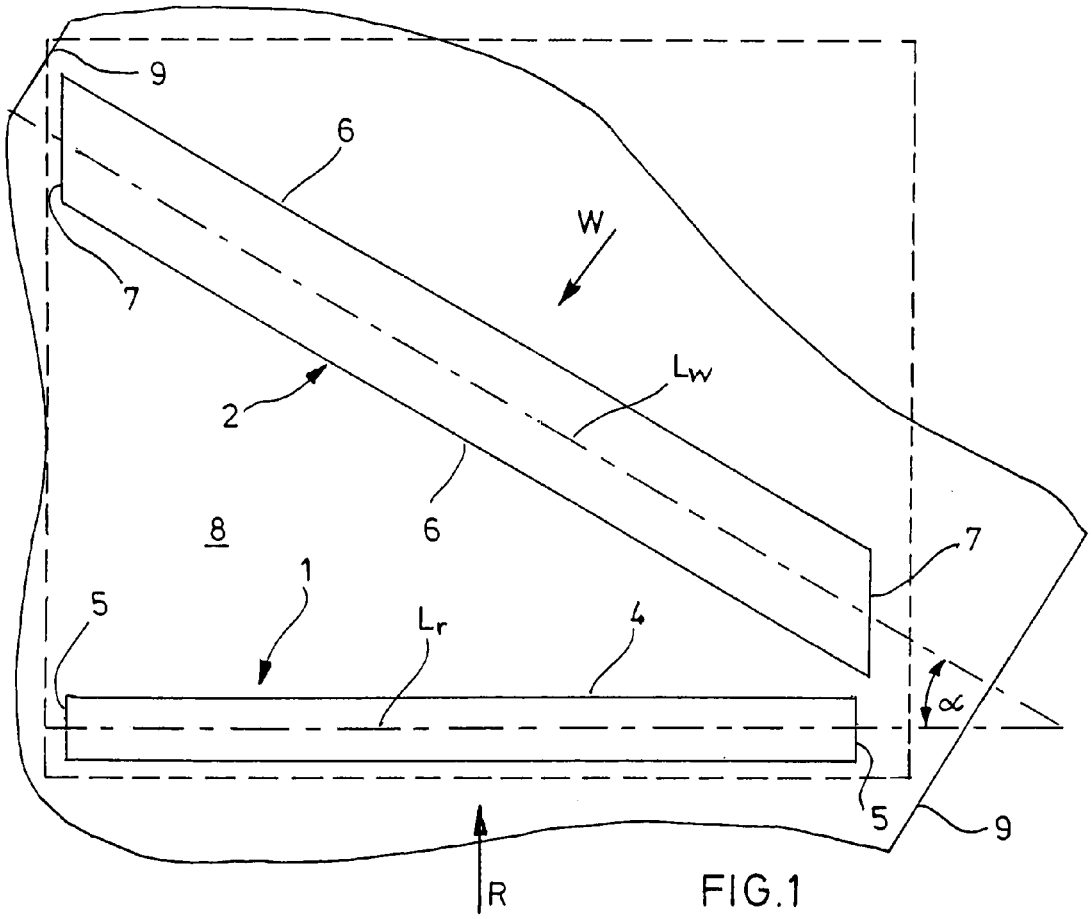

| | | | |
|---|---|---|---|
| EP | 0045559 | A1 | 2/1982 |
| EP | 0227425 | A1 | 7/1987 |
| FR | 2413045 | A1 | 7/1979 |
| FR | 2492230 | A1 | 4/1982 |
| FR | 2539961 | A1 | 8/1984 |

OTHER PUBLICATIONS

European Search Report from European Application No. 09305656.2 entitled Method of Wrapping Smoking Article Rods (Dated Jan. 29, 2010).

* cited by examiner

METHOD OF WRAPPING SMOKING ARTICLE RODS

RELATED APPLICATION

This is a National Phase Application pursuant to 35 U.S.C. §371 of International Application No. PCT/EP2010/003902, filed Jun. 25, 2010, claiming priority from European Patent Application No. EP 09305656.2, filed Jul. 7, 2009, the entire disclosures of both of which are hereby incorporated by reference herein.

BACKGROUND

The invention relates to a method of wrapping smoking article rods with a wrapper, in particular in the production of cigars, to an apparatus for performing the method and to a smoking article comprising a wrapper applied by means of this method.

Conventional cigars include tobacco surrounded by an inner wrapper, which preferably is made of reconstituted tobacco. The inner wrapper is surrounded by an outer wrapper (in the following just wrapper), which usually comprises a section cut from natural tobacco leaf.

In the production of cigars, smoking article rods are prepared, which present the tobacco wrapped in the inner wrapper. Usually, one smoking article rod of this kind is used for more than one cigar, wherein the rod (after applying the wrapper, as described in the following) is cut into pieces to form individual cigars.

The standard type of cigar wrapping machine based on the "bobbin system" includes a conveyer provided with a bobbin unwinder and a rewinder. A bobbin processed in this machine comprises a wound web and individual spaced wrappers (usually sections of natural tobacco leaf, as mentioned above), which have a longitudinal axis each and are arranged side by side on the web. That means, the longitudinal axes of the wrappers are generally running transversely (not necessarily orthogonally) with respect to the longitudinal direction of the web, and they are arranged in a spaced manner and more or less in parallel with respect to each other. When the web is wound, the wrappers stick between adjacent layers of the web such that they keep their positions.

In use of the machine, the bobbin is unwound, and an unwound section of the web is guided across a support, wherein the wrappers on that section of the web are exposed. Now each wrapper is picked up by means of a needle of a transfer device which passes the wrapper from the web to a rolling station. In the rolling station, the wrapper is helically wound, using three rollers, about an essentially fixed smoking article rod of the type described above, which has been moved before to the rolling station by a conveyer. The empty web passes to the rewinder where it is wound to form an empty bobbin.

The transfer device moves back and forth between the position where it picks up a wrapper from the unwound web and the rolling station where the wrapper is applied to the smoking article rod. Since the transfer device includes a relatively heavy arm, the production speed is limited due to the inertia and the reciprocating movement of this arm. Typically, about 80 smoking article rods per minute can be wrapped in this way, which corresponds to about 160 cigars per minute when one wrapped smoking article rod is cut into two cigars afterwards.

SUMMARY

It is the object of the invention to increase the speed of wrapping smoking article rods with a wrapper, in particular in the production of cigars.

This problem is solved according to a first aspect of the present invention, a method of wrapping smoking article rods. The method comprises several steps. A bobbin is provided and comprises a wound web and individual spaced wrappers arranged side by side on the web, with each of the wrappers having a longitudinal axis. The bobbin is unwound; and an unwound section of the web is guided across a support, wherein the wrappers on said section of the web are exposed. Individual smoking article rods, which have their longitudinal axes generally arranged in parallel, are fed towards the support when the smoking article rods are arranged such that an oblique angle is defined between the longitudinal axes of the smoking article rods and of the wrappers. Each smoking article rod is rolled over a corresponding one of the wrappers, wherein the corresponding one of the wrappers is taken up by the smoking article rod and helically wound about the smoking article rod.

According to another aspect of the present invention, an apparatus is provided. The apparatus is configured to perform the method of wrapping smoking article rods.

According to another aspect of the present invention, a method of manufacturing a first smoking article is provided. The method of manufacturing a first smoking article comprises the method of wrapping smoking article rods.

According to another aspect of the present invention, a smoking article is provided. The smoking article comprises a wrapper wrapped about a smoking article rod by means of the method of wrapping smoking article rods.

Advantageous versions of the invention emerge from the dependent claims.

The method according to the invention of wrapping smoking article rods with a wrapper is particularly advantageous in the production of cigars. It uses a bobbin comprising a wound web and individual spaced wrappers, e.g. cut sections of natural tobacco leaf with or without ribs. The wrappers have a longitudinal axis each, which generally (but not necessarily precisely) defines the longitudinal direction of the generally elongate wrapper, and are arranged side by side on the web. That means, the longitudinal axes of the wrappers placed on the web run transversely (but not necessarily orthogonally) with respect to the longitudinal direction of the web (i.e., the direction in which the web can be unwound from the bobbin). During the method, the bobbin is unwound, and an unwound section of the web is guided across a support, e.g. a support plate, wherein the wrappers on said section of the web are exposed.

Individual smoking article rods (preferably comprising tobacco surrounded by an inner wrapper, which can include reconstituted tobacco), which have their longitudinal axes generally arranged in parallel, are fed towards the support under an oblique angle between the longitudinal axes of the smoking article rods and of the wrappers. That means, this angle is well different from 90 degrees. In the next step, each smoking article rod is rolled over one of the wrappers, wherein said wrapper is taken up by said smoking article rod and helically wound about said smoking article rod. Afterwards, the wrapped smoking article rod can be moved away from the region of the support.

In the method according to the invention, there is no need for a reciprocating transfer device which, due to its inertia, would slow down the process. The web and the smoking article rods are moved in one direction each and not back and forth, and if any masses are stopped and accelerated during the process, these masses can be relatively small, which will become evident in the further description. It is possible to achieve a production rate of about 300 wrapped smoking article rods per minute, corresponding to 600 cigars per minute when each wrapped smoking article rod is cut into two cigars afterwards.

Since the rolling step takes place in the area of an unwound section of the web, i.e. along its natural path and not in a different area, an apparatus for performing the method according to the invention can have a compact design.

For performing the rolling step, in an advantageous embodiment of the invention, an endless belt is arranged in a spaced manner with respect to the support, and the belt is driven and engages at each of the smoking article rods. In this way, the respective smoking article rod is rolled, in the space between the support and the belt, over one of the wrappers. This design is less complicated than a conventional rolling station, generally resulting in higher reliability and less cost. The belt is generally small and has a low mass, thus it can be easily accelerated or decelerated in the process, if required.

The smoking article rods can be arranged side by side when they are fed towards the support. That means, their longitudinal axes are aligned roughly in parallel and in a spaced manner. It is also conceivable, however, that the smoking article rods are arranged end by end, i.e. along a common longitudinal axis, when they are moved to the support.

In advantageous embodiments of the invention, the support includes suction holes and the wrappers placed on the (porous) web are attracted towards the support by means of a vacuum. In this way, the wrappers are secured on the web in the area of the support, even when the web is moving. Since the vacuum forces acting on the wrappers can be more important than the gravitational forces, it is even possible to arrange the support in a vertical manner. The embodiments described below include one in which a planar support is arranged horizontally and one in which the support is mounted in a vertical manner. The vacuum transmitted through the suction holes in the support can be adjusted to secure the wrappers on the unwound section of the web, but nevertheless allow the respective wrapper rolled over by a smoking article rod to lift from the web and stick to the smoking article rod.

In an embodiment of the invention, the section of the web at the support is stopped while a smoking article rod is rolled over a wrapper. When the wrapper does not have a translational motion imposed by the web, the rolling step can be easily performed. In order to avoid accelerations and decelerations of the whole web including the bobbin, a compensator device can be arranged to enable a generally continuous movement of the bobbin while the section of the web at the support is stopped when a smoking article rod is rolled over a wrapper.

In an advantageous embodiment of the compensator device, the compensator device comprises a fixed support section, which forms the support, and an extendable section, which is arranged to extend the length of the support section in the moving direction of the web. Both the fixed support section and the extendable section can be provided with suction holes. The extendable section, which ends at a free end, is slidable with respect to the support section in the moving direction of the web from a retracted state to an extended state. The overall length of the support section and the extendable section up to the free end is larger in the extended state than in the retracted state. The extendable section is biased by spring means towards the extended state.

The part of the web from which the wrappers have already been removed can be successively wound on a second bobbin, which is driven to wind and tension the web (e.g., via a frictional clutch device). The speed of the web in the area of the support can be controlled by a controller, which can comprise a roller exerting frictional forces onto the web and controlling the web speed by its own rotational speed. In this way, that part of the web is always in a tensioned state and tends to be wound on the second bobbin.

In an advantageous embodiment using the compensator device, the web emerging from the bobbin is guided about the free end of the extendable section so that, in stopping or accelerating the section of the web at the support (by means of the controller), the compensator device, in interaction with the forces exerted by the web onto the extendable section, takes up or releases the additional web length delivered by the bobbin or required upon acceleration, respectively, and allows for a continuous movement of the bobbin. In other words, the compensator device allows for the involved change in geometry when the section of the web is stopped at the support during the rolling step and is accelerated afterwards in order to position the next wrapper for the subsequent rolling step. At the same time, the bobbin comprising the unused part of the web can continue its rotational motion (due to its inertia).

When an endless belt is used for performing the rolling step, as explained above, it is also possible to move the web generally continuously across the support and to avoid sudden accelerations or decelerations of the web. This can be achieved in that, in the area of the support and during a rolling step, the web moves, wherein the section of the endless belt opposite to the web has velocity components in parallel (which includes the term anti-parallel) to the moving direction of the web and perpendicular to the moving direction of the web. Moreover, in the area of the support and during a rolling step, the angle between the moving direction of the endless belt and the longitudinal axis of the smoking article rod to be rolled can be generally different from 90°, i.e. the moving direction of the endless belt can be generally non-perpendicular to the longitudinal axes of the smoking article rods fed to the support area. By adjusting the alignments of the web, the endless belt and the longitudinal axes of the smoking article rods and the speeds of the web and the endless belt, as explained in detail further below by means of an embodiment, it is possible to set up a geometry which transforms to a geometry in the rest frame of the web corresponding to a geometry in which the web does not move during the rolling step and in which the longitudinal axis of a smoking article rod is perpendicular to the moving direction of the endless belt such that the endless belt easily rolls the smoking article rod, which takes up the wrapper from the web. A less-than-ideal geometry may be advantageous as well, in which case some sliding forces might occur between the smoking article rod and the web (or the wrapper exposed on the web) and/or the endless belt.

In an embodiment of this kind, the endless belt, at the beginning of a rolling step, is moved transversely (with respect to the plane of the web) towards the web to contact a smoking article rod fed to the area of the support and, at the end of that rolling step, is moved transversely away from the web to release that wrapped smoking article rod. It is possible to provide a small and lightweight design of the endless belt, e.g. by keeping its motor stationary and using a transmission for driving the belt which allows for this reciprocating movement, such that the endless belt can be continuously driven and moved back and forth very quickly in order to roll a smoking article rod, release that wrapped smoking article rod, roll the next smoking article rod, etc. However, it is also possible to keep the distance between the web and the endless belt constant and to inject the next smoking article rod to be rolled over a wrapper into the space between the web and the endless belt at the right moment. This even allows for rolling several smoking article rods at the same time.

Each wrapper can be provided with glue before a smoking article rod is rolled over the wrapper. The glue can be sprayed onto the wrapper to form dots of glue, e.g. at least at the ends of the wrapper and also in intermediate positions (in particular when a wrapped smoking article rod is cut into several pieces afterwards). The glue fixes the wrapper after it has been helically wound about the smoking article rod and it also assists in taking up the wrapper during the rolling step.

As already mentioned, the smoking article rods can be designed for more than one individual smoking article each, e.g. for two or three individual smoking articles. In that case, after wrapping with the wrapper, the smoking article rods including the respective wrapper are cut to form the individual smoking articles. The speed of production is generally higher when the smoking article rods are processed in this way. However, the method according to the invention can be applied to smoking article rods designed for just one individual smoking article each as well.

After wrapping with the wrapper, at least one of the ends of the smoking article rods including the wrapper can be cut to shape. This step is useful to provide well-appearing wrapped smoking article rods. Although, in principle, the wrappers could be initially cut to a non-rectangular shape which takes into account the angle between the longitudinal axis of the wrapper and the longitudinal axis of the smoking article rod including the helically wound configuration of the wrapper, minor mis-alignments of the wrappers on the support and of the smoking article rods during the rolling step could deteriorate the appearance of the finished product without such cutting step.

The method according to the invention can also be applied when the smoking article rods comprise, at least at one of their ends, an area which is not to be wrapped with the wrapper. In this case, the smoking article rods and the wrappers, during the rolling step, are aligned to leave these areas free from the wrappers. An example of this kind is a smoking article rod comprising a filter (or a filter including a tipping paper) at one of its ends (or at both ends, if the smoking article rod is to be cut into two pieces after wrapping), which is not to be wrapped with the wrapper. Other examples of this kind, which do not include a filter but may be directed to, e.g., decorative applications, are conceivable as well. To achieve a good alignment, a sensor which detects the precise position of a wrapper in order, e.g., to trigger the injection of the smoking article rod to be rolled over that wrapper into the space between the web and the endless belt at the correct time can be useful. On the wrapped smoking article rod, the end area of the wrapper in the vicinity of the non-wrapped area can be covered by, e.g., a banderole.

The essential components of an apparatus for performing the method according to the invention have already become evident from the above description and will be disclosed in more detail by the embodiments below.

It is evident that the method according to the invention can be applied in a method of manufacturing smoking articles, wherein the manufacturing method includes additional steps which are known as such to a person skilled in the art.

BRIEF DESCRIPTION OF THE DRAWING FIGURES

In the following, the invention is further described by means of embodiments. The drawings show in FIG. 1 a schematic illustration of the basic geometry involved in the method according to the invention, FIG. 2 a three-dimensional view of a smoking article rod partially wrapped with a wrapper, FIG. 3 a schematic side view of a first embodiment of an apparatus for performing the method according to the invention, FIG. 4 a schematic side view of a second embodiment of an apparatus for performing the method according to the invention, FIG. 5 a schematic three-dimensional view of an embodiment of a compensator device, i.e. in part (*a*) in an extended state and in part (*b*) in a retracted state, FIG. 6 a schematic side view of an embodiment of the path of the web when using the compensator device according to FIG. 5, FIG. 7 a partial view as in FIG. 1 illustrating the condition for helically winding a wrapper of width b about a smoking article rod of diameter d, FIG. 8 views as in FIG. 1 illustrating the geometrical conditions for rolling a smoking article rod over a wrapper using an endless belt (not shown), i.e. in part (*a*) when the web is at rest and in part (*b*) when the web moves at a velocity $v_{web}>0$, and FIG. 9 in parts (*a*), (*b*) and (*c*) a sequence of consecutive frames which illustrate the rolling step of a smoking article rod rolled between a continuously moving web (seen in top view) and an endless belt, like in FIG. 8(*b*).

DETAILED DESCRIPTION OF THE PREFERRED EMBODIMENTS

Figure 2:
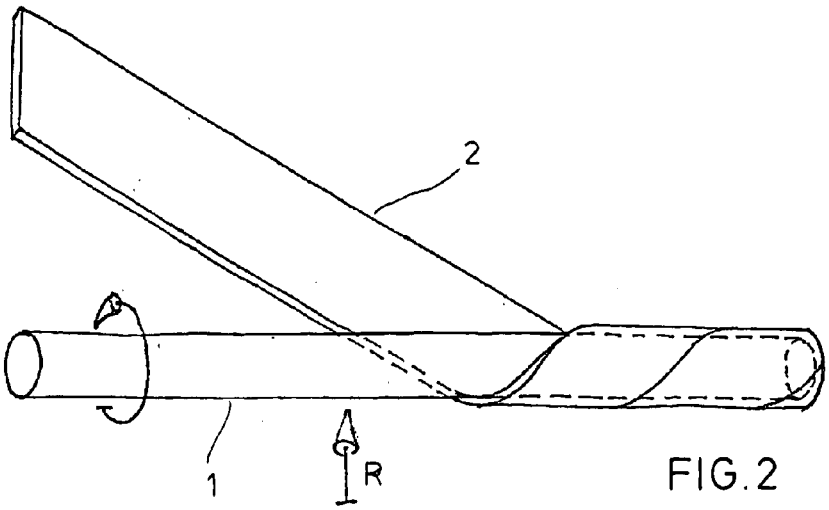

The basic principle of the method of wrapping smoking article rods is explained by means of FIG. 1 and FIG. 2.

FIG. 1 is a plane view onto a smoking article rod 1 and a wrapper 2 just before the wrapper 2 is wrapped about the smoking article rod 1.

In the embodiments, the smoking article rod 1 comprises cigar tobacco, which is surrounded by an inner wrapper made of reconstituted tobacco. After applying the wrapper 2, the wrapped smoking article rod is cut into two pieces to provide two cigars. It is also conceivable to cut the wrapped smoking article rod into more than two pieces. The smoking article rod 1 comprises a lateral wall 4 and two ends 5. Its longitudinal axis is designated by $L_r$.

The wrapper 2 has a parallelogram basic shape with two sides or longitudinal sides 6, two end sides 7, and a longitudinal axis $L_w$. It is arranged on a web 8, the longitudinal axis $L_w$ running roughly orthogonally with respect to the lateral sides 9 of the web 8. The web 8 is made of a porous fabric. As a rule, the web 8 is re-usable.

In the process, the smoking article rod 1 is generally fed or transported in the direction of arrow R. The web 8 is generally moved in the direction of arrow W. Thus, there is an oblique angle $\alpha$between the longitudinal axes L, of the smoking article rod 1 and $L_w$of the wrapper 2. $\alpha$is greater than zero (0) degrees and smaller than ninety (90) degrees.

On the web 8, wrappers like wrapper 2 are arranged in a spaced manner and side by side, i.e. with their longitudinal axes $L_w$ being spaced and running roughly orthogonally with respect to the lateral sides 9 of web 8. In the embodiment explained further below by means of FIG. 3, there is one wrapper 2 exposed at the top area of a support such that there is an area around each wrapper 2 free from adjacent wrappers, like the area indicated by the dashed line in FIG. 1.

In order to apply the wrapper 2 about the smoking article rod 1, the wrapper 2 is kept fixed (possibly in a moving reference frame, see below) while the smoking article rod 1 is rolled about its lateral wall 4 (in the embodiment, by means of a belt, as explained below) so that it moves in the direction of arrow R and moves over wrapper 2. In this way, the smoking article rod 1 takes up the wrapper 2 so that wrapper 2 is helically wound about the lateral wall 4 of smoking article rod 1 in order to produce a wrapped smoking article rod.

In the embodiment, the shape of the end sides 7 of wrapper 2 is designed to provide relatively smooth end sides of the wrapped smoking article rod. Because of tolerances, in particular with respect to the exact position of wrapper 2 on the web 8, it is advantageous to cut the ends of the wrapped smoking article rod in order to improve its appearance.

In order to prevent the wrapped wrapper 2 from unwinding, dots of glue can be placed close to the end sides 7 of wrapper 2 before the rolling process starts, as explained below. When the wrapped smoking article rod is cut into several pieces afterwards, glue areas should also be placed in the respective cutting regions of wrapper 2.

FIG. 2 is a three-dimensional view of smoking article rod 1 partially wrapped with wrapper 2. There is a relation between the diameter d of the smoking article rod 1, the width b of the wrapper 2 and the angle $\alpha$, which has to be observed. Otherwise the wrapped wrapper would exhibit gaps between adjacent windings. This relation is explained further below by means of FIG. 7.

Figure 3:
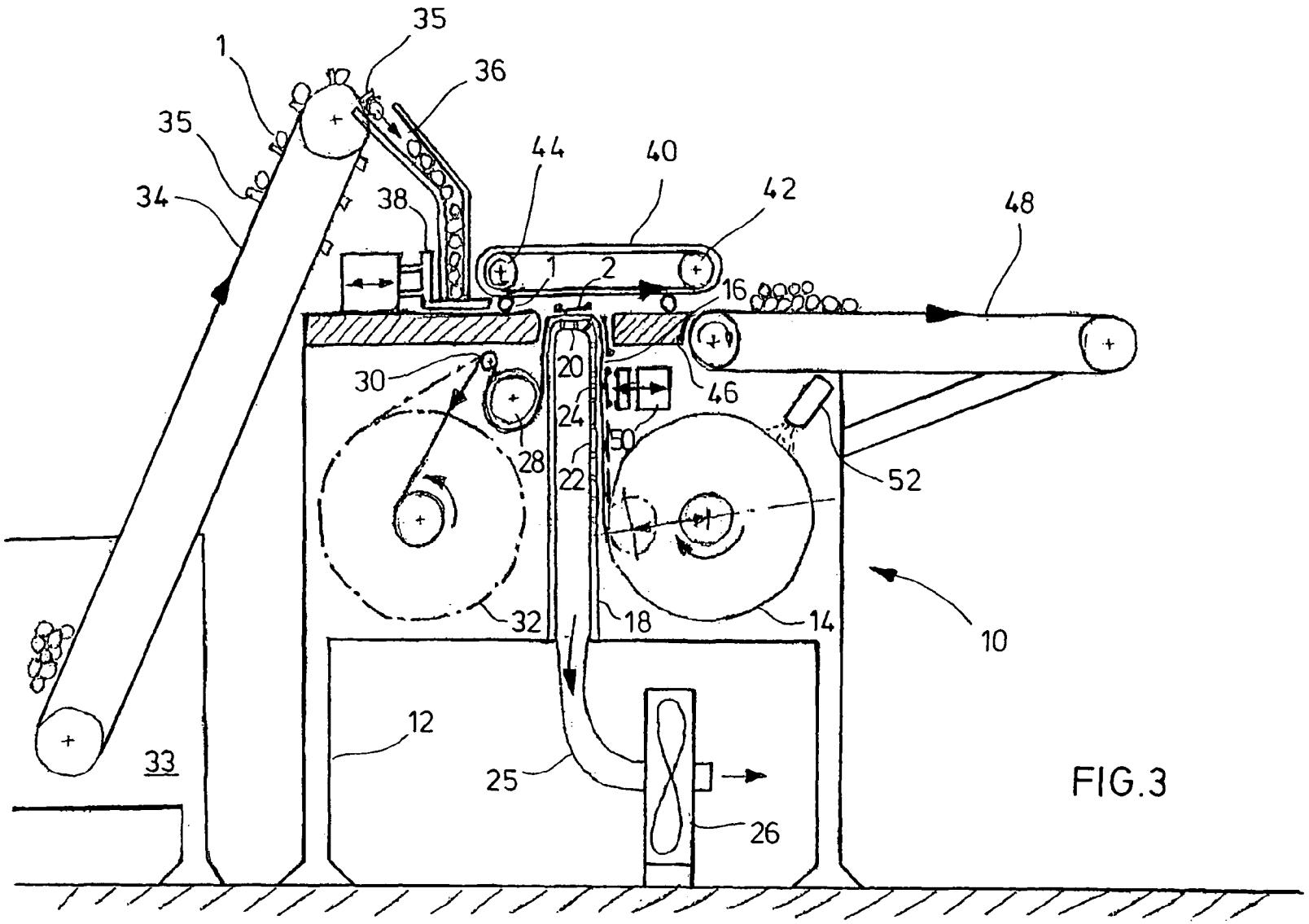

FIG. 3 shows a schematic side view of a first embodiment of an apparatus for performing the method according to the invention. This apparatus is designated as wrapping apparatus 10. Since FIG. 3 is a side view, the presence of the oblique angle $\alpha$ may not be well evident. However, the components used for feeding the individual smoking article rods 1 are arranged under an angle such that the top view geometry of FIG. 1 is achieved.

The wrapping apparatus 10 comprises a frame 12 for supporting the components of the wrapping apparatus 10 and replaceable components like a bobbin 14.

Originally, the web 8 is wound on bobbin 14. Wrappers, like wrapper 2, are arranged side by side on the web 8 and in a spaced manner, as described before. When the web 8 is wound on bobbin 14, the individual wrappers 2 are clamped between adjacent layers of the web 8 so that they are well fixed.

During the process, the web 8 is unwound from bobbin 14 in order to expose the wrappers 2. The unwound section 16 of web 8 is guided across a support device 18 which comprises a support plate 20 (support) at its top side and a lateral side 22. The lateral side 22 is provided with suction holes 24, and the support 20 can be provided with suction holes 24 as well. The interior space of the support device 18 is hollow, and it is connected via a vacuum hose 25 to a vacuum fan 26. In this way, partial vacuum can be created in the interior space of the support device 18 such that the exposed wrappers 2 are attracted towards the lateral side 22 and the support plate 20 of support device 18. As a result, the wrappers 2 safely stick to the web 8 and can be moved via the web 8, even along the vertically running lateral side 22 of the support device 18.

In the embodiment, the speed of web 8 is controlled by means of a speed control roller 28 which is positively driven by a motor not shown in FIG. 3. The roller 30 presses the web 8 onto the speed control roller 28 so that, in this area of the apparatus 10, the web 8 assumes the same speed as speed control roller 28.

The empty web 8 is wound on a second bobbin 32 (after the wrappers 2 have been wound about the smoking article rods 1, see below). In the embodiment, the second bobbin 32 is driven by a motor (not shown in FIG. 3) which, via a clutch, exerts a torque onto the second bobbin 32. As a result, the area of the web 8 between the speed control roller 28 and the second bobbin 32 is always in a tensioned state.

From a supply 33, smoking article rods like smoking article rod 1 are conveyed by a feeder 34, which comprises a belt and a plurality of pockets 35 attached to the belt. Each pocket 35 takes up one smoking article rod 1, and once a given pocket 35 reaches the topmost position of feeder 34, it drops its smoking article rod 1 into a channel 36 wherein the smoking article rods 1 are arranged side by side and with their longitudinal axes $L_r$ essentially in parallel.

At the lower end of channel 36, a reciprocating kicker 38 pushes the lowermost smoking article rod 1 out of channel 36 into a space underneath an endless belt 40. Afterwards, the kicker 38 moves back so that the next smoking article rod 1 in channel 36 can move into a position in front of kicker 38.

The endless belt 40 is guided by a driven roller 42, the motor of which is not shown in FIG. 3, and a guide roller 44. After the smoking article rod 1 has been pushed by kicker 38 into the space underneath the belt 40, it is rolled by the belt 40 over a support face and over the wrapper 2 which is just exposed on web 8 on the support 20, as explained before by means of FIGS. 1 and 2. Afterwards, the wrapped smoking article rod is rolled by means of belt 40 across a fixed plate 46 until it reaches the end of the operational area of belt 40. There, it is taken by an output conveyer 48, which is also designed as an endless belt guided by a driven roller (motor not shown in FIG. 3) and a guide roller, and transferred to an output storage box not shown in FIG. 3.

Moreover, FIG. 3 shows a gluing device 50 by means of which dots of glue are sprayed, using pressurized air, onto certain areas of the wrappers 2 transported by web 8 to the support 20.

FIG. 3 also indicates a sprayer 52 which sprays water droplets onto the outermost layers of the web 8 which are still wound on bobbin 14. This water moistens the wrappers 2 arranged on the web 8 in order to decrease their brittleness and has the additional effect that the wrappers 2 stick better to the web 8 on the passage between bobbin 14 and support 20. It is conceivable, wherever, that the initial moisture of the wrappers 2 on bobbin 14 is sufficient so that the sprayer 52 is not required.

From the above description, it is evident how the process of wrapping a smoking article rod 1 with a wrapper 2 is performed. The process is repeated for each following smoking article rod 1 moved into the area of belt 40 and each wrapper 2 transferred via the web 8 to the support 20.

The precise timing of the process steps is controlled by a controlling device which is not shown in FIG. 3. This involves the control of speed control roller 28, the actuation of kicker 38, the drive of the endless belt 40 and the actuation of the gluing device 50.

In the embodiment, the speed control roller 28 is stopped when the smoking article rod 1 under the belt 40 is to be rolled over the wrapper 2 present on the support 20. Whereas the belt 40, because of its low mass/inertia can be accelerated and stopped without problems to ensure a precise timing, if required at all, a sudden stop of speed control roller 28 would result in a strong tension force in the area of web 8 between the roller 30 and the second bobbin 32, caused by the corresponding deceleration of the second bobbin 32. In order to avoid this stroke, a compensator device can be provided that is arranged to enable a general continuous movement of the web 8 while the section of the web 8 at the support 20 is stopped. Such compensator device could include, e.g., a guide roller between roller 30 and the second bobbin 32 having its axis in parallel to that of roller 30 and being mounted so that it can change its position in space, thus changing the effective length of the web between the roller 30 and the second bobbin 32. Compensator devices of this kind are generally known in the art. Further below, another embodiment of a compensator device will be described in more detail.

Figure 4:
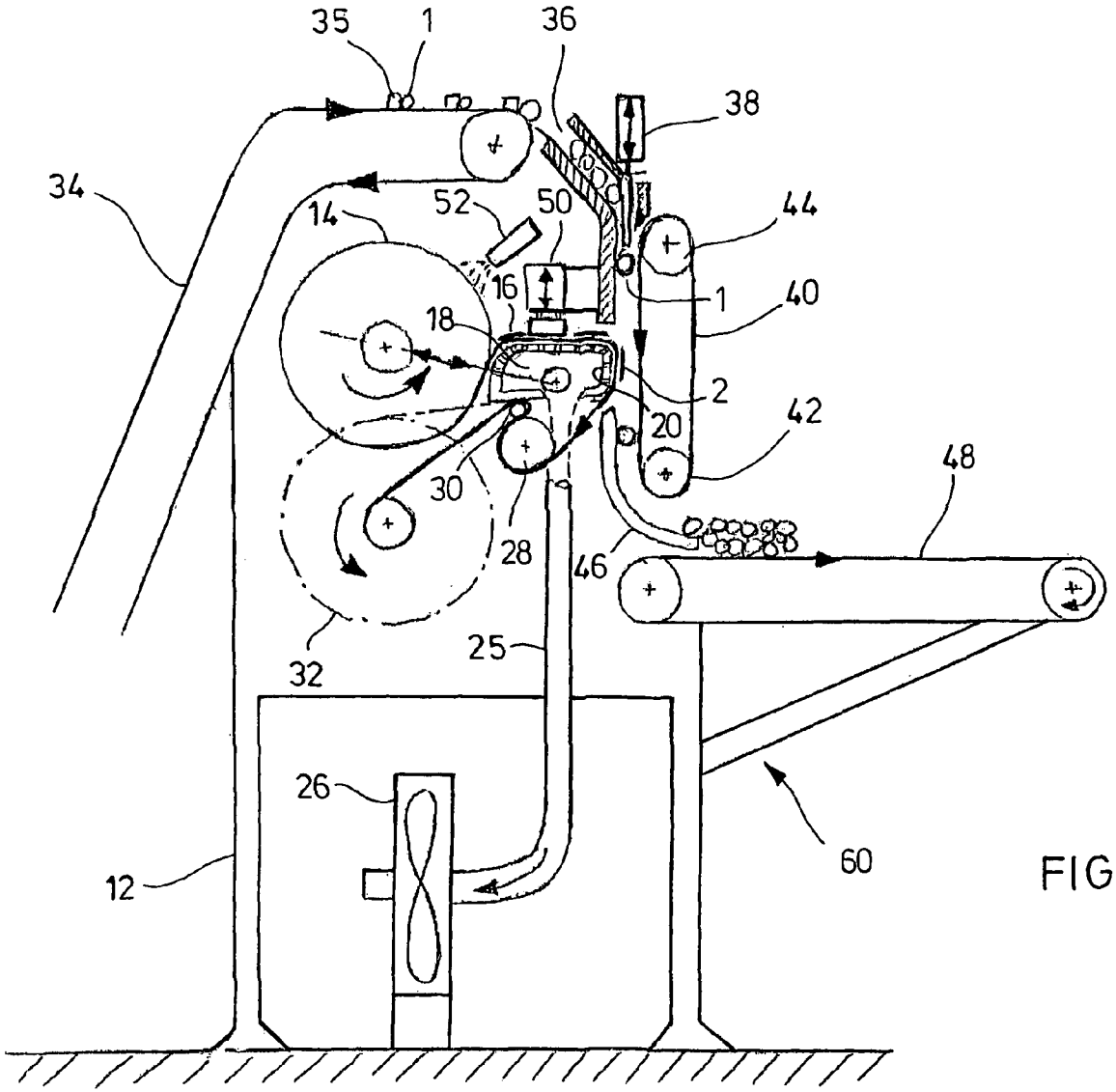

FIG. 4 displays another embodiment of a wrapping apparatus, which is designated by reference numeral 60.

The general design of the wrapping apparatus 60 is very similar to that of the wrapping apparatus 10 according to FIG. 3. For that reason, the same reference numerals are used in both embodiments for the same or for comparable components.

The main difference between wrapping apparatus 60 and wrapping apparatus 10 is the arrangement of the endless belt 40. As shown in FIG. 4, the belt 40 of wrapping apparatus 60 rolls the smoking article rods in a vertical direction, the support 20 being arranged in a vertical manner as well. That is possible because the smoking article rods 1 are safely guided in the space on the left side of belt 40 by forces which are generally much larger than the gravitational force acting onto a smoking article rod 1. The wrapping apparatus 60 is somewhat more compact than the wrapping apparatus 10 and has a smaller base area.

Figure 5:
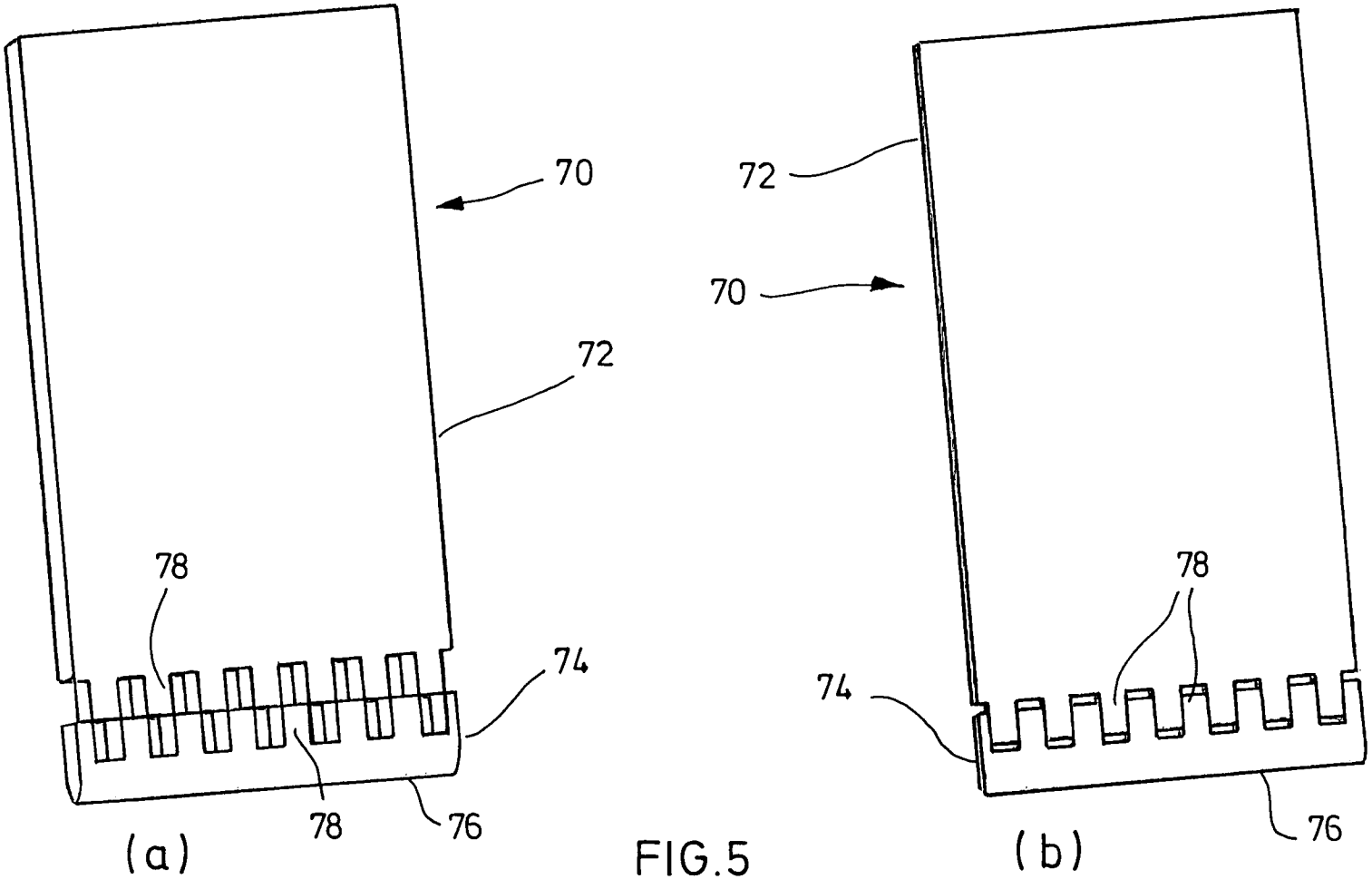

FIG. 5 illustrates an embodiment of a compensator device, which is designated by reference numeral 70. The compensator device 70 comprises a fixed support section 72 and an extendable section 74 with a rounded free end area 76. The extendable section 74 is slidably mounted with respect to the support section 72. Fingers 78 arranged at the support section 72 and at the extendable section 74 provide a more or less continuous support area, irrespective of the position of the extendable section 74 with respect to the support section 72.

FIG. 5(*a*) shows the most extended state, in which the overall length of the compensator device 70 has a maximum, and Figure (*b*) shows the fully retracted state, in which the overall length has a minimum. An internal spring biases the compensator device 70 towards its extracted state. When a force having a component in the longitudinal direction of the compensator device 70 acts onto the free end area 76, the overall length of the compensator device 70 decreases.

In the embodiment, the support section 72 of the compensator device 70 forms the support corresponding to support 20, see above. The compensator device 70 is hollow and is provided with suction holes.

Figure 6:
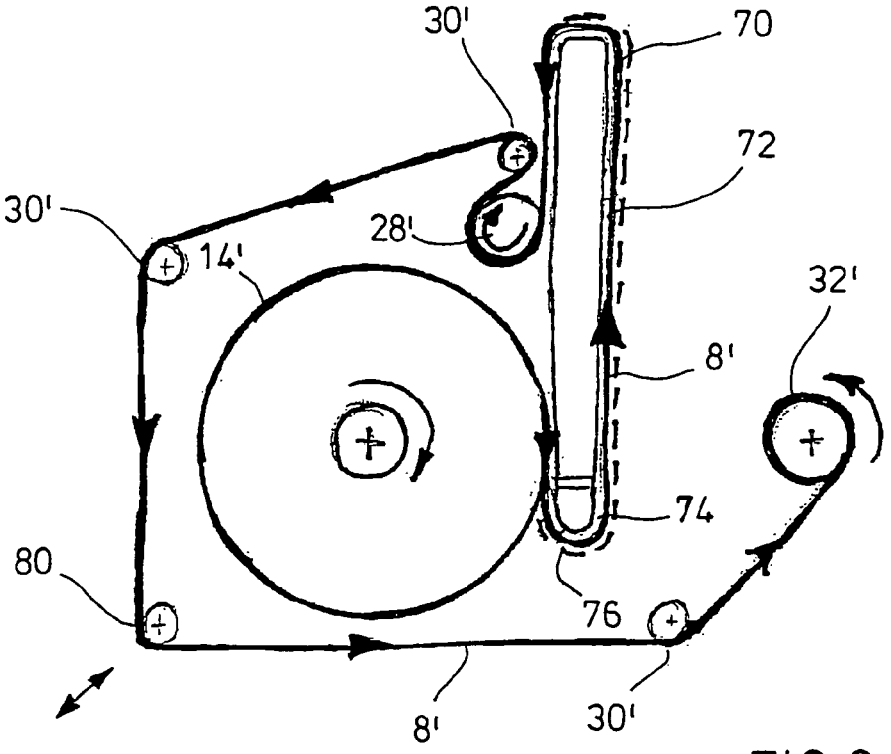

FIG. 6 is a schematic side view of the path of the web in a wrapping apparatus similar to that of FIG. 3 which uses the compensator device 70 shown in FIG. 5.

In this embodiment, a web 8' supporting individual spaced wrappers emerges from a bobbin 14' and is guided about the rounded free end area 76 of the extendable section 74 of compensator device 70. The area for performing the rolling step is provided at the narrow top side of the compensator device 70, like in the embodiment according to FIG. 3.

The web 8' is pulled by a speed control roller 28', which is also used in order to stop and to accelerate the web 8', similar to the embodiment described by means of FIG. 3. The web 8' is guided by several rollers 30', until it is wound on a second bobbin 32'. The rotational axis of one of the rollers, which is designated by reference numeral 79, can move against a force excerted by a spring in a transverse direction indicated by the double arrow in FIG. 6.

Other components of the apparatus similar to those of the embodiment according to FIG. 3, like a vacuum fan for creating a vacuum in the interior space of the compensator device 70, a gluer or an endless belt used for rolling the smoking article rods, are not shown in FIG. 6.

In the operation of the embodiment according to FIG. 6, the web 8' is stopped when a smoking article rod is to be rolled over a wrapper exposed at the top side of the compensator device 70. The bobbin 14', due to its inertia, continues to rotate such that an extra amount of web 8' is unwound. This section of web, however, is stretched by the extendable section 74, which moves downwards under spring force because the tension of the web 8' decreases in that area.

After the rolling step has been completed, the web 8' is accelerated by the speed control roller 28' and moves faster than at its average speed. This causes an extra tension in the area of the extendable section 74, which moves to its retracted state, thus providing the extra amount of web 8' required during the acceleration process. When the next smoking article rod is to be wrapped, the speed control roller 28' stops again, and the cycle described so far is repeated. In this way, the extendable section 74 moves up and down, while the bobbin 14' maintains a more or less constant rotational speed.

In the embodiment illustrated in FIG. 6, the second bobbin 32' is driven via a clutch device providing a continuous pull. In order to avoid strokes when the web 8' is stopped, the roller 79 can move inwards in order to shorten the path length of web 8' between the speed control roller 28' and the second bobbin 32' such that the second bobbin 32' does not have to be stopped as well, but can continue to rotate.

Whereas in the embodiments according to FIGS. 3 to 6 the web 8 or 8' is stopped during the rolling step, it is also possible to roll the smoking article rods 1 over the respective wrappers 2 while the web moves. In this case, the drive of the web can be controlled to keep the web at a generally constant speed, which avoids problems due to web deceleration and web acceleration and generally does not require a compensator device.

Figure 7:
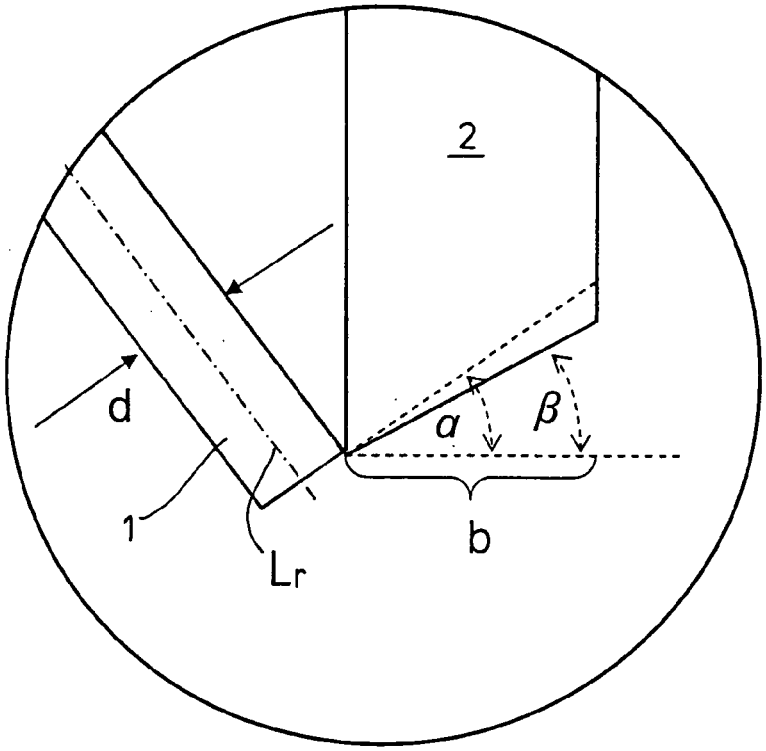

Before this is explained in detail, it is referred to FIG. 7. FIG. 7 is a partial view as in FIG. 1 and shows a smoking article rod 1 (diameter d) to be rolled over a wrapper 2 (width b). The angle $\alpha$ is the same angle as in FIG. 1, although in FIG. 7 it is indicated at a different location. The angle $\beta$ characterises the cut angle of wrapper 2. It is evident from FIG. 7 that the condition $$\alpha \geq \beta$$

has to be fulfilled when the smoking article rod 1 first touches wrapper 2 at its lower left corner, as in FIG. 7. Otherwise, after wrapping, the end area of smoking article rod 1 would not be completely covered by the wrapper 2.

Moreover, it is possible to show that the condition $$\alpha \geq \arccos(b/(\pi.d))$$

has to be observed in order to avoid gaps and to provide some overlap between adjacent windings of the wrapped wrapper.

Figure 8:
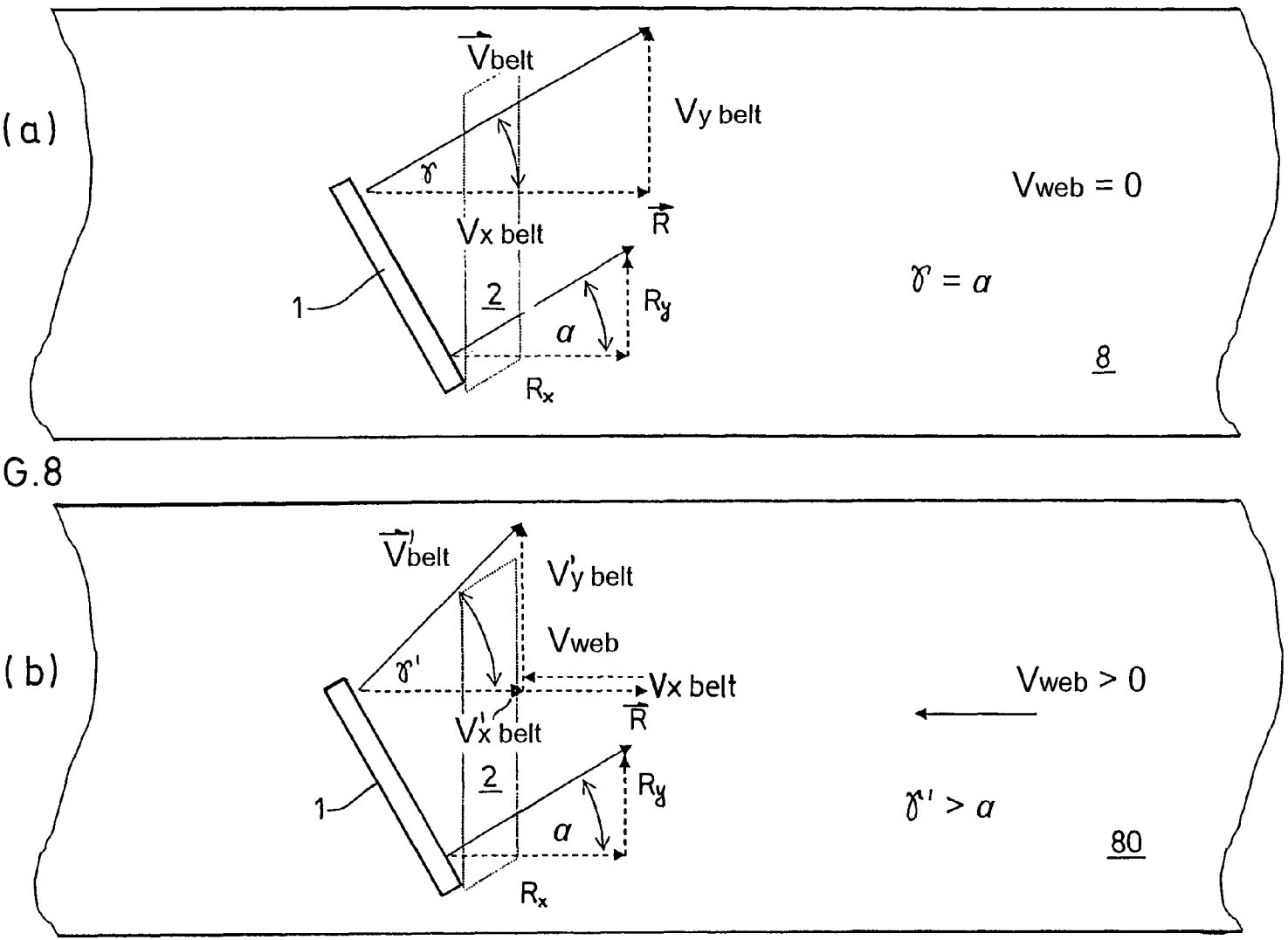

Turning now to embodiments including a generally continuously moving web, FIG. 8 compares the geometries during the rolling step, when a smoking article rod 1 is rolled over a wrapper 2 exposed on the web. In FIG. 8(*a*), the web 8 is stopped during the rolling step, i.e. it has the velocity $v_{web}=0$. In FIG. 8(*b*), the web (here designated by 80) maintains its motion with a generally constant speed $v_{web}>0$ (generally in $\pm x$ direction). In both cases, the smoking article rod 1 is rolled over the wrapper 2 by means of an endless belt (not shown in FIG. 8), as explained before. When the smoking article rod 1 is rolled, it moves in the direction R of FIG. 1, which is expressed as a unit vector R having components $R_x$ and $R_y$ in FIG. 8. It is evident that $\alpha=\arctan(R_y/R_x)$.

In FIG. 8(*a*), the endless belt, on its side facing the resting web 8, moves with a velocity $v_{belt}$, which is a vector in parallel to R and runs at an angle $\gamma=\arctan(v_{y\ belt}/v_{x\ belt})$ with respect to the x axis, with $\gamma=\alpha$. This ensures a rolling step in a well-defined geometry and without problems. $v_{belt}$ has the components $v_{x\ belt}$ and $v_{y\ belt}$. When the smoking article rod 1 is rolled (without sliding) by the endless belt, the speed of the center of gravity of smoking article rod 1 is half the absolute value of $v_{belt}$.

When the web is moved, as in FIG. 8(*b*), the smoking article rod 1 will experience the same rolling conditions as in FIG. 8(*a*) if the x and y components of the relative velocity between the web and the side of the belt facing the web do not change. According to FIG. 8(*b*), that means:

$$v'_{x\,belt}=v_{x\,belt}-v_{web}$$

$$v_{y\,belt}=v_{y\,belt}$$

Here, $v'_{belt}$ is the velocity vector of the endless belt on its side facing the web. In other words, the endless belt has to be aligned at an angle $\gamma'=\arctan(v'_{y\,belt}/v'_{x\,belt})$ which is different from the angle $\gamma$ from FIG. 8(*a*) in order to achieve the same effect; $\gamma'>\alpha$.

In both examples given in FIG. 8, the center of gravity of the smoking article rod 1 (or its longitudinal axis) generally moves to the right, i.e. one of the velocity components points to the right, but because of the speed of the web this velocity component is smaller in the case of FIG. 8(*b*) than in the case of FIG. 8(*a*). By changing the speeds of the web and the endless belt as well as the angles, the set-up can be adjusted to a large variety of arrangements. It is even possible to run the web in the opposite direction compared to FIG. 8(*b*) with the direction of the endless belt not being reversed, which results in the condition $\gamma'<\alpha$.

Figure 9A:
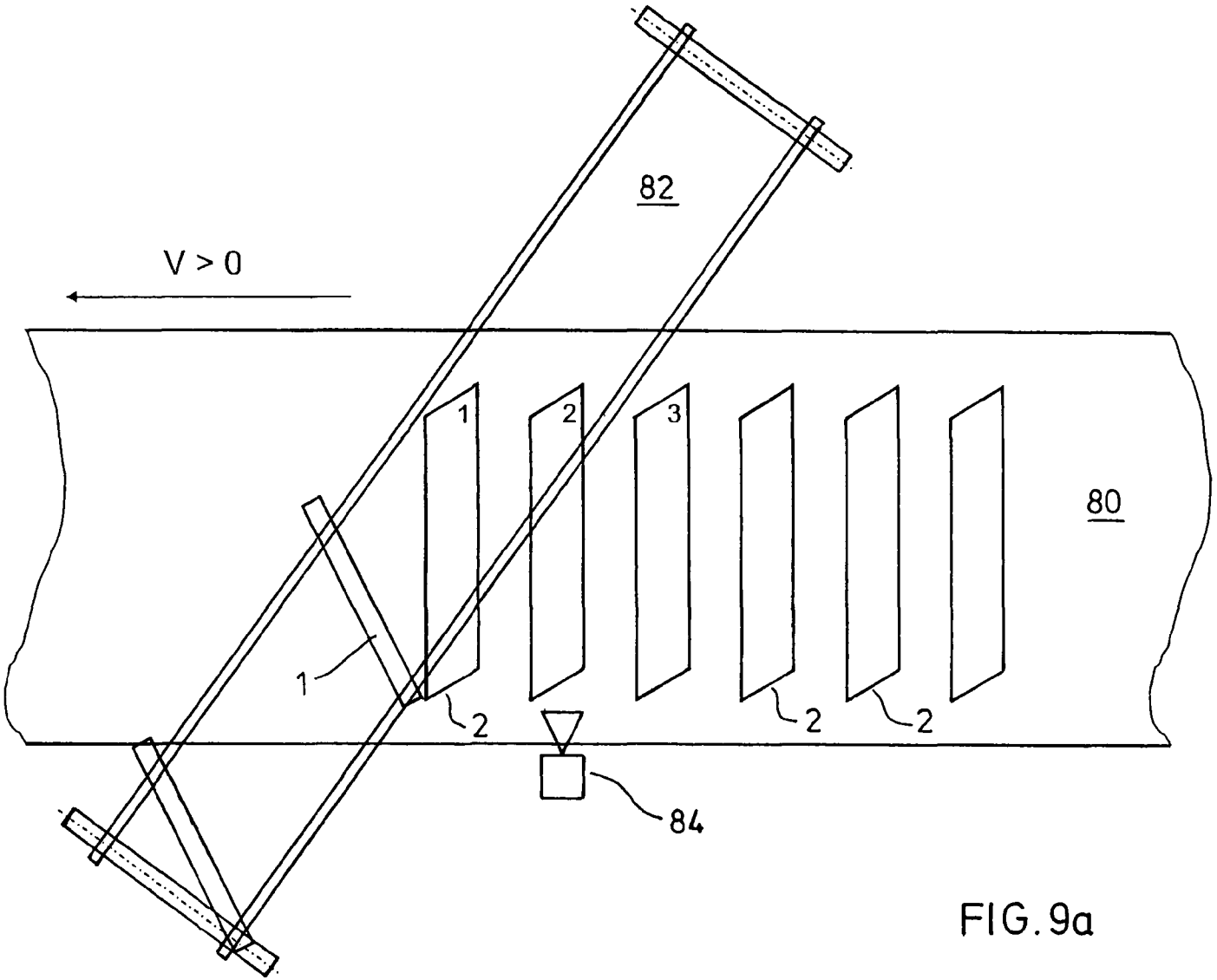
Figure 9B:
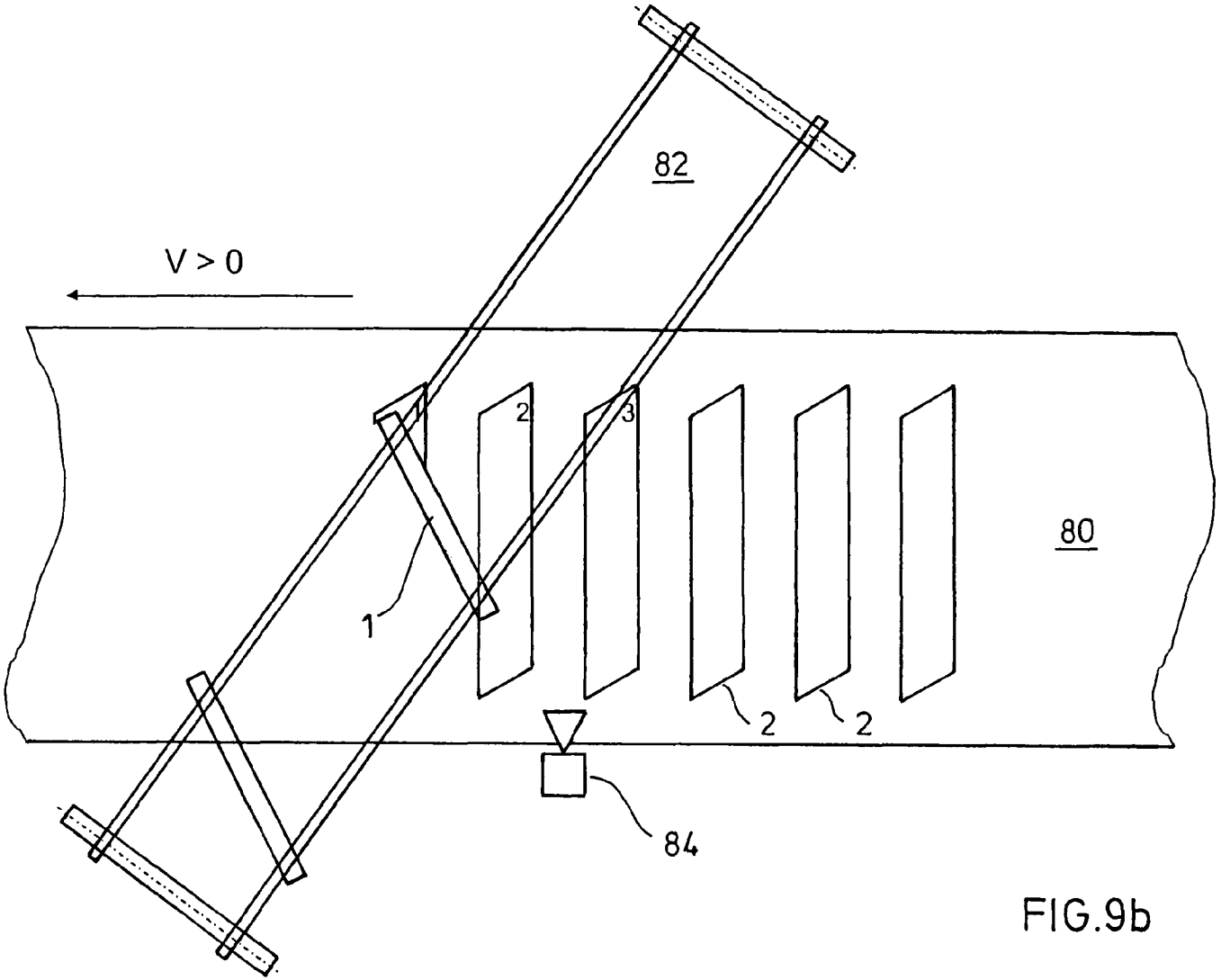
Figure 9C:
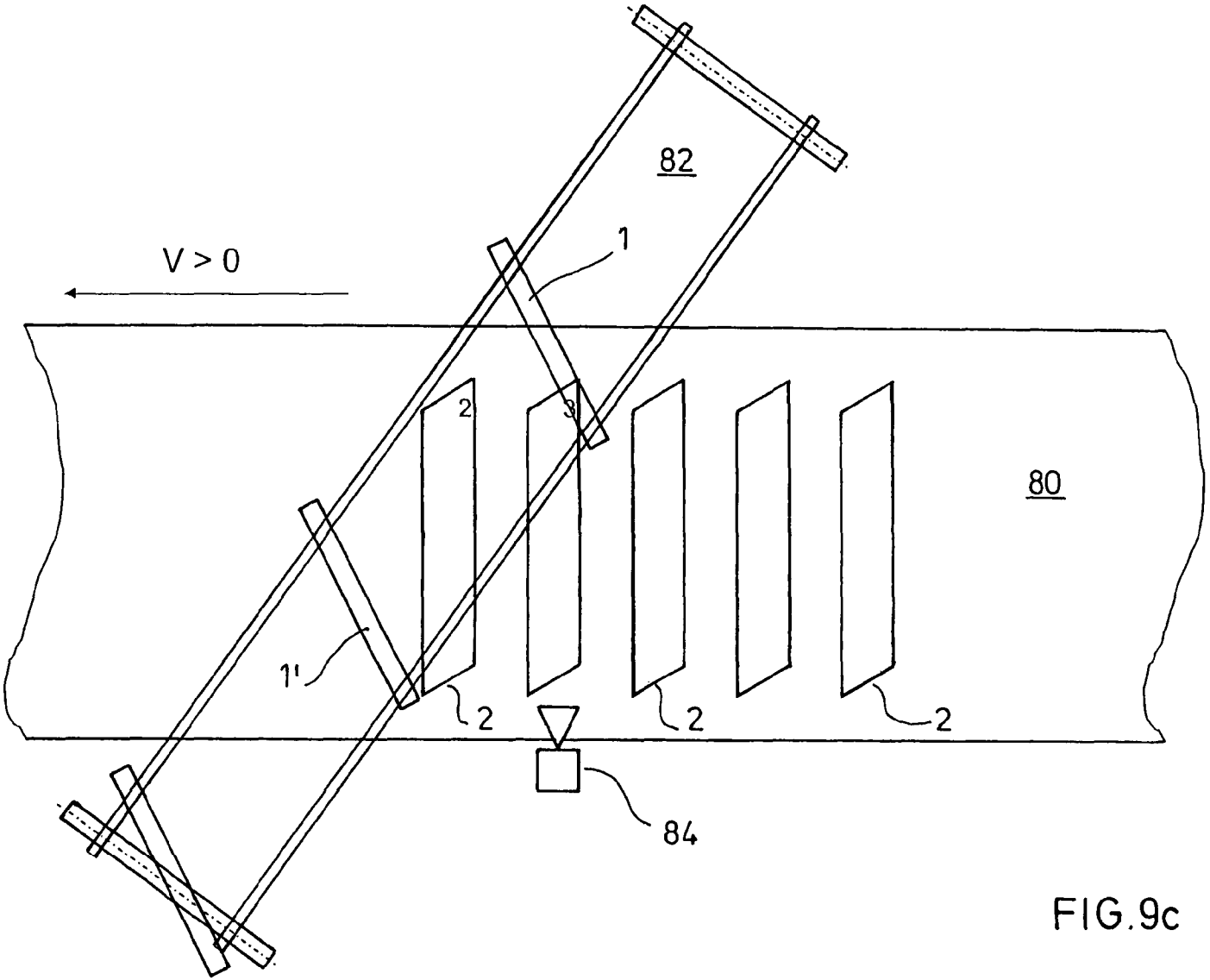

FIG. 9 in parts (*a*), (*b*) and (*c*) displays, in top view, a sequence of consecutive frames which illustrate the rolling step of a smoking article rod 1 rolled as illustrated by means of FIG. 8(*b*). The smoking article rod 1 is rolled between the continuously moving web 80 (velocity designated by v and indicated by an arrow) and the endless belt (schematically shown in FIG. 9 and designated by 82). To guide the eye, the first three wrappers 2 exposed on the web 80 are designated by the numbers (1), (2), and (3).

In the first frame according to FIG. 9(*a*), the smoking article rod 1 to be rolled next just touches wrapper No. (1). Rolled by the combined action of web 80 (to be more precise, the movement of wrapper No. (1) imposed by the web) and the endless belt 82, this smoking article rod is rolled over wrapper No. (1), see FIG. 9(*b*), as explained by means of FIG. 8(*b*). Finally, wrapped smoking article rod 1 is ready to leave the area of the web 80 and the endless belt 82, see FIG. 9(*c*), whereas the next smoking article rod (here designated by 1') is ready to be rolled over wrapper No. (2).

FIG. 9 shows a sensor 84 which detects the position of the wrappers 2 in order to trigger the insertion of a respective smoking article rod 1 into the area between the web 80 and the endless belt 82 at the right moment. For example, sensor 84 can be used to control a kicker like kicker 38 displayed in FIG. 3.

It is evident from FIG. 9(*c*) that several smoking article rods are present in the rolling area at the same time. This allows for a large production speed of the apparatus. Since, e.g., wrapped smoking article rod 1 has to be moved across wrapper No. (2) and partially across wrapper No. (3) without taking up these wrappers No. (2) and No. (3), the glue mentioned above has to be applied to a respective wrapper 2 just before the wrapper comes into contact with the smoking article rod it is to be wrapped about. Alternatively, the support for web 80 could be designed different from the plane support suggested by FIG. 9 so that a wrapped smoking article rod 1 does not contact the next wrapper(s) 2 upon leaving the rolling zone.

The invention claimed is:

1. A method of wrapping smoking article rods, including the steps of:

providing a bobbin comprising a wound web and individual spaced wrappers arranged side by side on the web, with each of the wrappers having a longitudinal axis;

unwinding the bobbin and guiding an unwound section of the web across a support, wherein the wrappers on said section of the web are exposed;

feeding individual smoking article rods, which have their longitudinal axes generally arranged in parallel, towards the support when the smoking article rods are arranged such that an oblique angle is defined between the longitudinal axes of the smoking article rods and of the wrappers; and rolling each smoking article rod over a corresponding one of the wrappers, wherein said corresponding one of the wrappers is taken up by said smoking article rod and helically wound about said smoking article rod, wherein an endless belt is arranged in a spaced manner with respect to the support, wherein said belt is driven and engages each of the smoking article rods, wherein each respective smoking article rod is rolled, in the space between the support and the belt, over the corresponding one of the wrappers.

2. The method according to claim 1, wherein the smoking article rods, during feeding towards the support, are arranged side by side.

3. The method according to claim 1, wherein the support includes suction holes, wherein said wrappers are attracted towards the support by means of a vacuum.

4. The method according to claim 1, wherein, during the rolling step, the web moves and a section of the endless belt opposite to the web has velocity components in parallel to a moving direction of the web and perpendicular to the moving direction of the web.

5. The method according to claim 4, wherein an angle is defined between a moving direction of the endless belt and the longitudinal axis of each of the smoking article rods to be rolled, said angle being generally different from 90°.

6. The method according to claim 4, wherein, at the beginning of the rolling step, the belt is moved transversely towards the web to contact one of the smoking article rods fed to the area of the support, wherein, at the end of the rolling step, the belt is moved transversely away from the web to release a wrapped smoking article rod.

7. The method according to claim 1, wherein each of the wrappers is provided with glue before one of the smoking article rods is rolled over the corresponding one of the wrappers.

8. The method according to claim 7, wherein the glue is sprayed onto each one of the wrappers to form dots of glue.

9. The method according to claim 8, each one of the wrappers presenting wrapper ends, wherein, for each one of the wrappers, dots of adhesive are formed on at least one of the wrapper ends.

10. The method according to claim 1, wherein each of the smoking article rods comprises tobacco surrounded by an inner wrapper.

11. The method according to claim 10, wherein the inner wrapper comprises reconstituted tobacco.

12. The method according to claim 1, wherein each of the smoking article rods is designed for more than one individual smoking article, wherein, after being wrapped with the corresponding one of the wrappers, each of the smoking article rods and the corresponding one of the wrappers are cut to form the individual smoking articles.

13. The method according to claim 12, wherein each of the smoking article rods forms two or three individual smoking articles.

14. The method according to claim 1, each of said smoking article rods presenting rod ends, each of said rod ends corresponding to a respective wrapper end, wherein, after each of the smoking article rods has been wrapped with the corresponding one of the wrappers, at least one of the rod ends and the respective wrapper end are cut to shape.

15. The method according to claim 1, each of said smoking article rods presenting rod ends, at least one of the rod ends of each of the smoking article rods comprising an area which is not to be wrapped with the corresponding one of the wrappers, wherein each of the smoking article rods and the corresponding one of the wrappers, during the rolling step, is aligned to leave the area free from the corresponding one of the wrappers.

16. The method according to claim 1, wherein the support comprises a support plate.

17. A method of wrapping smoking article rods, including the steps of:

providing a bobbin comprising a wound web and individual spaced wrappers arranged side by side on the web, with each of the wrappers having a longitudinal axis;

unwinding the bobbin and guiding an unwound section of the web across a support, wherein the wrappers on said section of the web are exposed;

feeding individual smoking article rods, which have their longitudinal axes generally arranged in parallel, towards the support when the smoking article rods are arranged such that an oblique angle is defined between the longitudinal axes of the smoking article rods and of the wrappers; and rolling each smoking article rod over a corresponding one of the wrappers, wherein said corresponding one of the wrappers is taken up by said smoking article rod and helically wound about said smoking article rod, wherein the section of the web at the support is stopped while one of the smoking article rods is rolled over the corresponding one of the wrappers.

18. The method according to claim 17, wherein a compensator device is arranged to enable a generally continuous movement of the bobbin while the section of the web at the support is stopped when one of the smoking article rods is rolled over the corresponding one of the wrappers.

19. The method according to claim 18, wherein the compensator device comprises a fixed support section, which forms the support, and an extendable section, which is arranged to extend the length of the support section in a moving direction of the web, said extendable section ending at a free end, said extendable section being slidable with respect to the support section in the moving direction of the web between a retracted state and an extended state, the overall length of the support section and the extendable section up to the free end being larger in the extended state than in the retracted state, said extendable section being biased by spring means towards the extended state.

20. The method according to claim 19, wherein, after the wrappers are removed from the web, the web is successively wound on a second bobbin, wherein the second bobbin is driven to wind and tension the web, wherein the speed of the web in the area of the support is controlled by a controller, wherein the web emerging from the bobbin is guided about the free end of the extendable section so that, in stopping or accelerating the section of the web at the support, the compensator device takes up or releases, respectively, additional web length and allows for a continuous movement of the bobbin.

21. The method according to claim 20, wherein the controller comprises a roller.

22. The method according to claim 17, wherein the smoking article rods, during feeding towards the support, are arranged side by side.

23. The method according to claim 17, wherein the support includes suction holes, wherein said wrappers are attracted towards the support by means of a vacuum.

24. The method according to claim 17, wherein each of the wrappers is provided with glue before one of the smoking article rods is rolled over the corresponding one of the wrappers.

25. The method according to claim 17, wherein each of the smoking article rods comprises tobacco surrounded by an inner wrapper.

26. The method according to claim 17, wherein each of the smoking article rods is designed for more than one individual smoking article, wherein, after being wrapped with the corresponding one of the wrappers, each of the smoking article rods and the corresponding one of the wrappers are cut to form the individual smoking articles.

27. The method according to claim 17, each of said smoking article rods presenting rod ends, each of said rod ends corresponding to a respective wrapper end, wherein, after each of the smoking article rods has been wrapped with the corresponding one of the wrappers, at least one of the rod ends and the respective wrapper end are cut to shape.

28. The method according to claim 17, each of said smoking article rods presenting rod ends, at least one of the rod ends of each of the smoking article rods comprising an area which is not to be wrapped with the corresponding one of the wrappers, wherein each of the smoking article rods and the corresponding one of the wrappers, during the rolling step, is aligned to leave the area free from the corresponding one of the wrappers.

29. The method according to claim 17, wherein the support comprises a support plate.

30. The method according to claim 17, wherein, during the rolling step, the web moves and a section of the endless belt opposite to the web has velocity components in parallel to a moving direction of the web and perpendicular to the moving direction of the web.

* * * * *